United States Patent [19]

Loubier et al.

[11] Patent Number: 5,030,937

[45] Date of Patent: Jul. 9, 1991

[54] MAGNET ROLL

[75] Inventors: Robert J. Loubier, Roanoke; William F. Bleeke, Fort Wayne, both of Ind.

[73] Assignee: Xolox Corporation, Fort Wayne, Ind.

[21] Appl. No.: 388,960

[22] Filed: Aug. 2, 1989

[51] Int. Cl.[5] ..... H01F 7/02

[52] U.S. Cl. ..... 335/303; 118/657; 29/125

[58] Field of Search ..... 335/303, 306; 118/657, 118/658; 29/115, 121.1, 124, 125, 132

[56] References Cited

U.S. PATENT DOCUMENTS

| | | | |
|---|---|---|---|
| 3,721,189 | 3/1973 | Bray | 335/306 X |
| 4,517,719 | 5/1985 | Okumura | 29/124 |
| 4,558,294 | 12/1985 | Yamashita | 335/303 |
| 4,587,699 | 5/1986 | Kadomatsu | 29/121.1 |
| 4,638,281 | 1/1987 | Baermann | 335/303 |

*Primary Examiner*—George Harris

*Attorney, Agent, or Firm*—Pearne, Gordon, McCoy & Granger

[57] ABSTRACT

A magnet roll for an electrophotographic device includes a magnet carrier assembly constituted by a plurality of identical cylindrical segments of injection molded plastic material. The segments are coaxially arranged and longitudinally aligned in an end-to-end relationahip on a spindlelike metal rod constituting the magnet roll axis of rotation. The segmented carrier assembly provides a plurality of longitudinally extending channels circumferentially spaced about the carrier assembly. The bottom of each channel has along its length a central groove that functions as a locator for an extruded, flexible magnet strip that mounts within the channel, each magnet strip having along the length of its underside a centered tongue that fits into the locator groove of its respective channel. Such a magnet roll provides for highly accurate positioning of the outer working surfaces of the magnet strips.

17 Claims, 3 Drawing Sheets

20
22
24
25
26
30
30a
30b
30c
30d
30e
40
50a
50b
50c
50d
50e
50f
52
54
56
57
58
64
68
A
N
S

MAGNET ROLL

BACKGROUND OF THE INVENTION

The present invention relates in general to electrophotographic devices such as photocopiers and the like, and more particularly to the magnet roll portion of a magnetic brush assembly for conveying powdery developer, commonly referred to as toner, used in magnetic brush developing, magnetic brush cleaning, etc.

A magnetic brush assembly includes a cylindrical nonmagnetic sleeve encasing a smaller diameter cylindrical magnet roll coaxially and rotatably mounted within the cylindrical sleeve. With the magnet roll held in position, the sleeve is rotated to convey magnetic particles of developer, the particles being temporarily held on the outer surface of the nonmagnetic sleeve due to the magnetic flux provided by a plurality of permanent magnet strips carried in parallel relation to each other on the cylindrical surface of the magnet roll within the sleeve.

In order to provide the required flux profile or gradient generated by the magnet strips circumferentially distributed about the cylindrical magnet roll, the magnet strips carried thereon must be straight and accurately positioned relative to the roll axis of rotation. Each magnet strip must be radially spaced from the roll axis by a fixed distance along its entire length. Also, each strip must be maintained in exact parallel relation with other strips and with the roll axis along its entire length. Such precise positioning requirements are difficult to obtain, especially when the magnet strips are constituted by flexible strips of extruded magnetic material, such as chlorinated polyethylene filled with barium ferrite particles, as is common in the art.

It is known in the art to provide a magnet roll having a one piece, cylinder-shaped, magnet carrier assembly with longitudinally extending channels circumferentially distributed about the carriers' axis of rotation. Flexible strips of extruded magnetic material are mounted and retained within the channels, the side walls or edges of the strips engaging the side walls of the channels.

In such a prior art structure, it is difficult and expensive to size and shape the channels and strips so as to precisely position the magnet strips as noted above. Other prior art magnet roll structures are set forth in U.S. Pat. Nos. 4,517,719, 4,558,294 and 4,587,699, all incorporated herein in their entirety by reference for purposes of background.

SUMMARY OF THE INVENTION

In accordance with the present invention, an improved magnet roll for use in the magnetic brush assembly of an electrophotographic device such as a photocopier is provided.

An elongated cylindrical magnet carrier mountable for rotation on its longitudinal axis provides a plurality of parallel channels extending along the length of the magnet carrier. The channels are circumferentially spaced about the outer surface of the cylindrical magnet carrier and are radially spaced from and parallel to the magnet carrier rotation axis.

A plurality of elongated magnet strips are mounted and retained within the channels, each magnet strip having an outer or upper working surface and an inner or lower surface generally contiguous with the bottom portion of the channel in which it is mounted. Locator means are provided between the bottom portion of the channel and the lower surface of the magnet strip so that the magnet strip is precisely aligned along its entire length within its channel to provide for a desired magnetic flux profile or gradient about the magnet roll.

Preferably, the locator means is a tongue and groove joint extending along and between the bottom portion of the channel and the lower surface of the magnet strip. A centrally located groove extends along the length of the bottom portion of the channel, while a centrally located tongue extends from and along the length of the lower surface of the magnet strip, the tongue fitting into and engaging the groove to maintain the strip in a predetermined centered position within the channel. This structure is particularly useful when the magnet strips are flexible as a result of their extrusion from rubber-like, plastic material.

Preferably, the elongated cylindrical magnet carrier is constituted by a plurality of cylindrical segments coaxially arranged and longitudinally aligned in end-to-end relationship along the magnet carrier axis of rotation which can be provided by a linear spindlelike member such as a metal bar or tube on which the cylindrical segments are coaxially mounted. At least some of the magnet carrier segments are fixed against rotational movement on the spindlelike member by locking pins.

In further accordance with the invention, a method of forming a magnet roll is provided wherein the above noted plurality of magnetic carrier segments are sequentially slid over an end of the spindlelike member providing the axis of rotation for the magnet roll, each of the segments providing portions of the channels into which the magnet strips fit. The segments are longitudinally aligned to provide the noted channels. This can be accomplished by use of a metal alignment bar in the shape of one of the magnet strips, the bar substantially filling the width of a channel so that the metal bar acts as an alignment tool. Once alignment is obtained, the metal bar is removed and the appropriately sized magnet strip is put in its place. To hold the segments in alignment, suitable adhesive can be used on the butted segment ends to fix them in position relative to each other after initial alignment using the alignment bar has been obtained.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
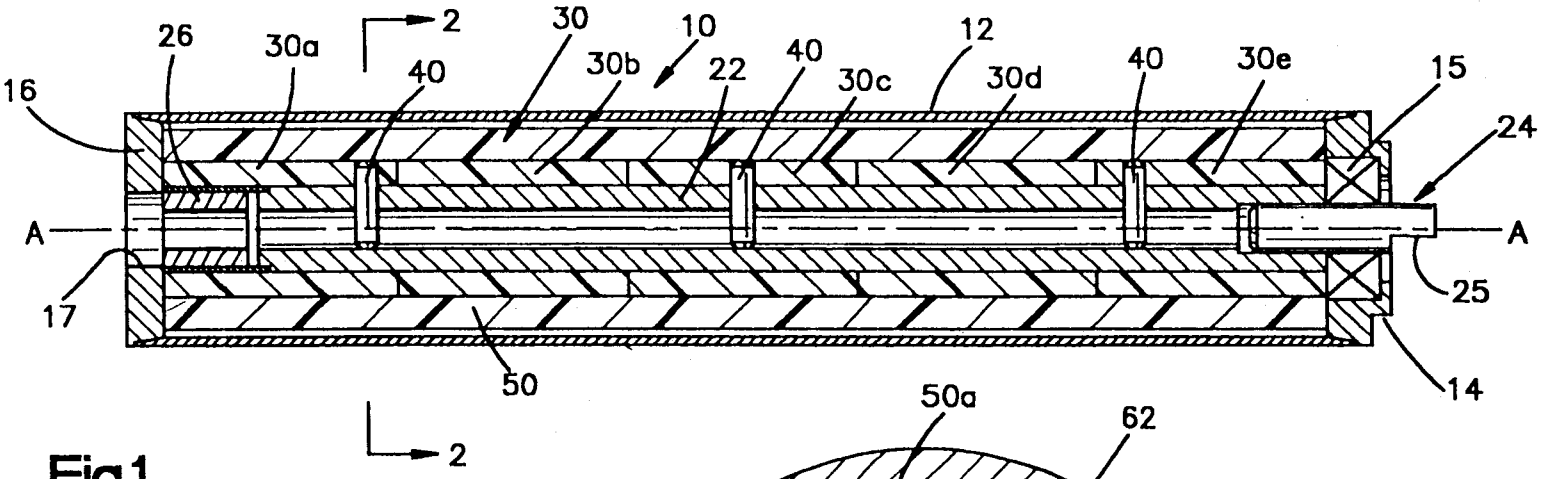
FIG. 1 is an elevation view, longitudinal cross section of a magnetic brush assembly incorporating a magnet roll in accordance with the present invention.
Figure 2:
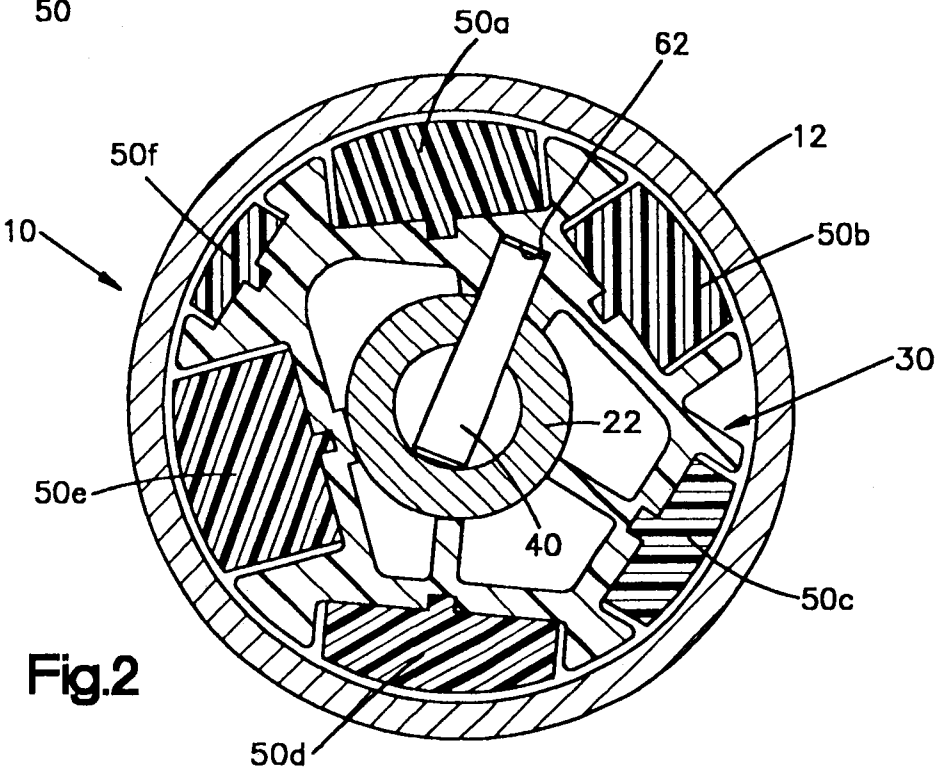
FIG. 2 is a transverse cross section view of the magnetic brush assembly of FIG. 1 taken along line 2—2 thereof.
Figures 3, 4, 5, 6, 7:
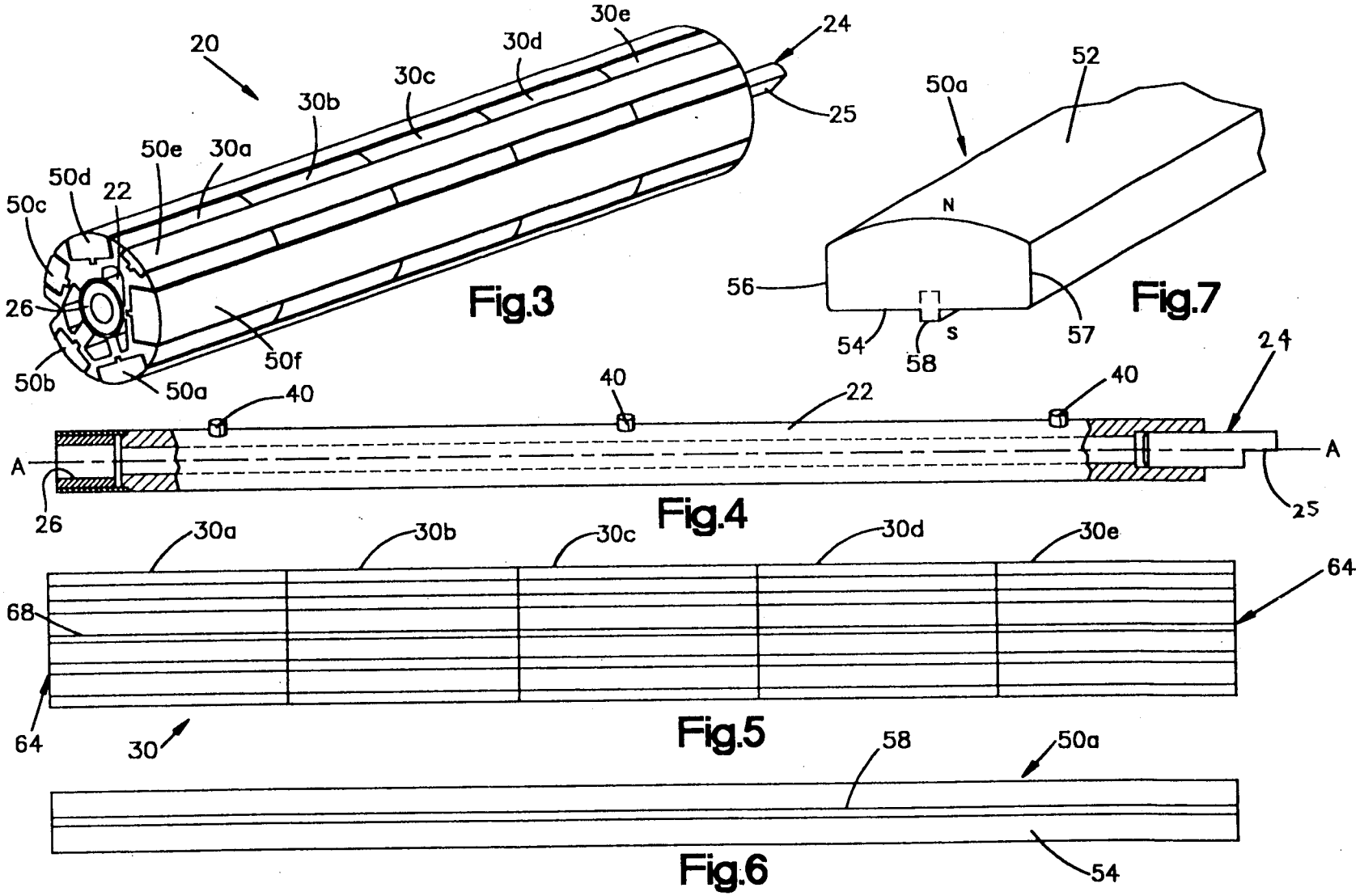
FIG. 3 is a perspective view of the magnet roll in accordance with the present invention removed from the magnetic brush assembly illustrated in FIGS. 1 and 2.
FIG. 4 is an elevation view, with portions cut away, of a linear spindlelike member constituting a part of the magnet roll of FIG.3.
FIG. 5 is an elevation view of a segmented magnet carrier forming part of the magnet roll FIG. 3.
FIG. 6 is a bottom view of one of the magnet strips forming a part of the magnet roll FIG. 3.
FIG. 7 is a perspective end view of an end portion of the magnet strip illustrated in FIG. 6.

With reference to FIGS. 1 through 3, a magnetic brush assembly 10, for use in an electrophotographic device such as a photocopier, is mounted on a longitudinal axis of rotation A—A as illustrated.

The magnetic brush assembly 10 includes, in a manner known in the art, a cylindrical, non-magnetic cylindrical sleeve 12 formed, for example, of thin wall aluminum tubing. A first end cap or gudgeon 14 is pressed into and generally closes the right end (as viewed in FIG. 1) of the sleeve 12. The first end cap 14 is cup-shaped to provide a circular recess for receiving a conventional ball bearing assembly 15 having an inner race and an outer race separated by a plurality of ball bearings. The end cap has a central aperture as illustrated. A second end cap or gudgeon 16 is generally disc-shaped and has a annular cross section with a central aperture defined by an inner wall 17 the second end cap being pressed into and generally closing the left end (as viewed in FIG. 1) of the sleeve 12.

The sleeve 12 and the end caps 14, 16 define a cylindrical housing which encases a smaller diameter cylindrical magnet roll 20 (also see FIG. 3) which is the subject matter of the present invention. The magnet roll 20 is rotatably supported and coaxially mounted within the assembly constituted by the sleeve 12 the end caps 14, 16 and the ball bearing assembly 15, both the magnet roll 20 and the coaxially mounted sleeve 12 being rotatable on the longitudinal axis of rotation A—A.

The magnet roll 20 includes a linear spindlelike member or shaft 22 in the preferred form of a rigid metal tube of aluminum having coaxial bores at both ends (also see FIG. 4). With particular reference to FIG. 1, the right end of the shaft 22 has press fitted into it a stub shaft 24 whose distel end provides a flat 25. Thus, the stub shaft 24 is fixed in position relative to the spindlelike member 22, an inwardly adjacent cylindrical portion of the stub shaft 24 riding and rotating within the inner race portion of the ball bearing assembly 15. The leftward end (as viewed in FIG. 1) of the shaft 22 has press fitted into it an annular bushing 26 that can be formed of self-lubricating sintered bronze for example. As is known in the art, a conventional drive shaft (not illustrated) is press fitted into the second end cap aperture as defined by the inner wall 17, the shaft end extending into the bushing 26 and being rotatable relative thereto. It can be seen that the bearing assembly 15 and the bushing 26 thus allow the sleeve 12 to rotate relative to the magnet roll 20 which is radially spaced to a slight degree from the inner wall of the sleeve 12 as illustrated most clearly in FIG. 2.

With further reference to FIGS. 1 through 3, the magnet roll 20 includes, in addition to the shaft subassembly shown in FIG. 4, an elongated, cylindrical magnet carrier 30 which is comprised of a plurality of magnet carrier segments 30*a*, 30*b*, 30*c*, 30*d*, and 30*e*, which are each cylindrical in shape and are coaxially arranged in end-to-end or butted relationship with each other as illustrated. The carrier segments 30*a*–30*e* are generally identical to each other and are preferably formed of injection molded thermal plastic material. Such segments are longitudinally aligned to provide a plurality of channels, radially spaced from and circumferentially distributed about the axis A—A, and in which are mounted magnet strips 50 which are specifically illustrated as being constituted by flexible magnet strips 50*a*, 50*b*, 50*c*, 50*d*, 50*e* and 50*f* and which provide alternating magnetic poles around axis A—A as known in the art. The magnet strips 50*a*–50*f* are of different sized cross sections to provide different amounts of magnetic flux so as to provide about the length of the cylindrical magnet roll 20 the desired magnetic flux profile or gradient for transferring magnetic particles of developer material (toner) onto or from the outer surface of the nonmagnetic sleeve 12 (see FIG. 1) in a manner known in the art as discussed earlier.

The shaft 22, and the magnet carrier segments 30*a*–30*e* are maintained in fixed positions relative to each other by the use of a plurality of locking pins 40 which extend between the shaft 22 and the carrier segments 30*a*, 30*c*, and 30*e* as illustrated in FIGS. 1 and 2.

A further understanding of the magnet roll 20 and a preferred method of assembling it can be had by reference to FIGS. 4 through 8.

With specific reference to FIG. 4, as discussed earlier, the shaft 22 can be formed by a length of aluminum tubing that has a true outer cylindrical surface coaxial to the axis A—A. Centerless grinding may be employed for the purpose of assuring uniform concentricity of the outer surface of the shaft 22. Three longitudinally aligned holes are drilled through the wall of the tubular shaft 22 and pins 40 are press fitted into such drilled holes (see also FIGS. 1 and 2) so that the pins extend radially from and perpendicular to the axis A—A at a precise rotational angle relative to the plane in which flat 25 lies to ensure accurate positioning of the segments 30*a*–30*e* relative to the flat 25, the pins having distal ends extending from the outer surface of the shaft 22 as best illustrated in FIG. 4. One of the pins 40 is centered along the shaft 22, with leftward and rightward pins 40 equidistantly spaced therefrom. As noted earlier, FIG. 4 illustrates a subassembly of the magnet roll 20 onto which are sequentially slid the magnet carrier segments 30*a*–30*e* constituting the magnet carrier as best shown in FIG. 5 and FIG. 8.

Figure 8:
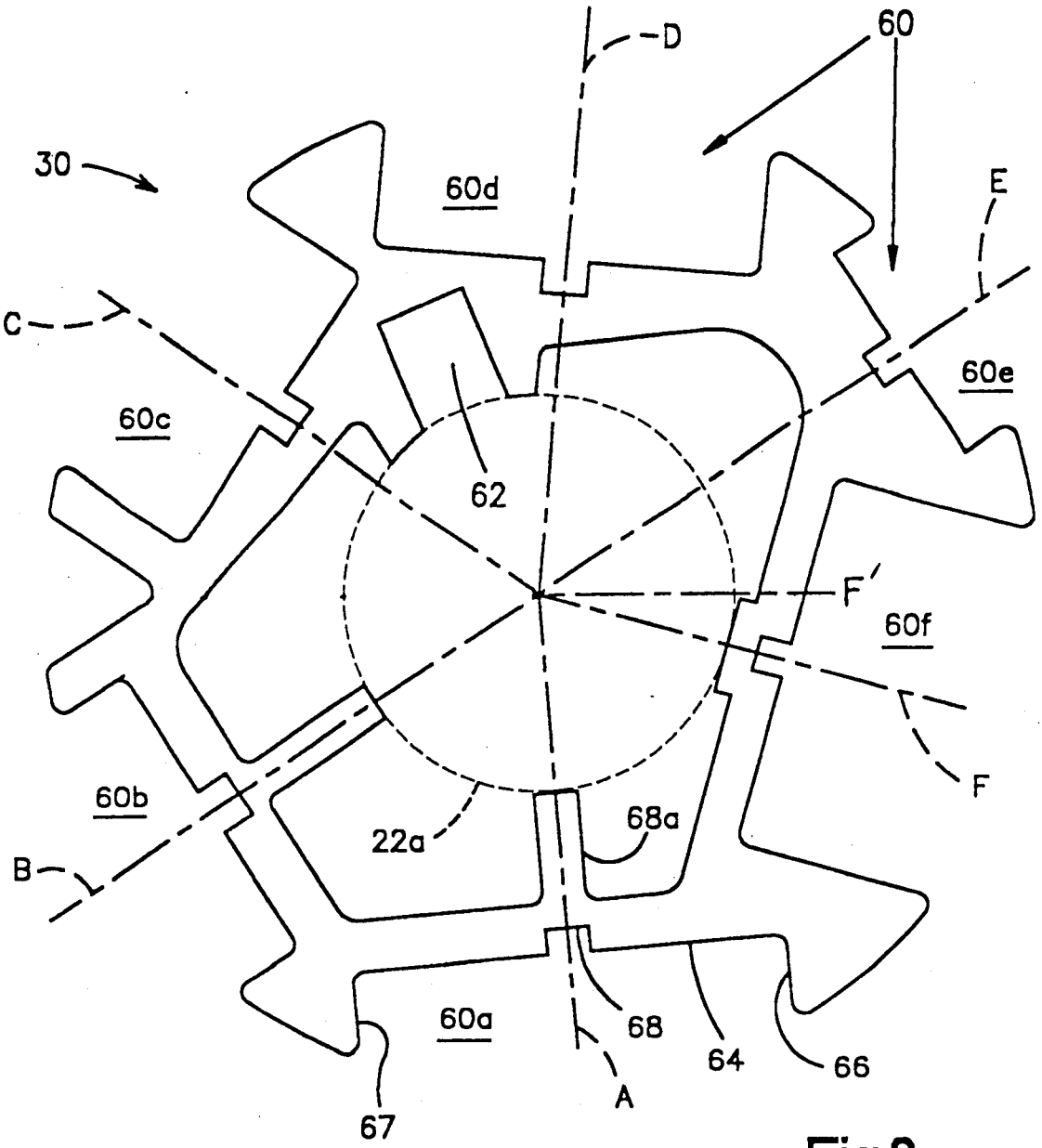
FIG. 8 is an end view of the segmented magnet carrier illustrated in FIG. 5.

With specific reference to FIG. 8, each segment (30*a*–30*e*) of the magnet carrier 30 is formed by the extrusion or molding of suitable thermal plastic material includes a plurality of longitudinally extending parallel channels 60 of generally rectangular cross section, more specifically identified in FIG. 8 as channels 60*a*60*b*, 60*c*, 60*d*, 60*e* and 60*f*, each of these channels respectively having mounted within it and retaining within it, corresponding magnet strips 50*a*, 50*b*, 50*c*, 50*d*, 50*e*, and 50*f* (illustrated most clearly in FIG. 2). As shown in FIG. 8, and with specific reference to channel 60*a* (it being recognized that the remaining channels 60*b*–60*f* are identical in structure to channel 60*a* but for different cross sectional dimensions), it can be seen that channel 60*a* includes a floor or bottom portion 64 and a pair of opposed sidewalls 66, 67. A centrally located groove 68, preferably having a rectangular cross section as illustrated and supported from below by a bridge portion 68*a*, extends along the entire length of the channel 60*a* (also see FIG. 5), each of the magnet carrier segments 30 providing an equal portion of the channel 60*a* as well as portions of the other channels 60*b*–60*f*. As further shown in FIG. 8, a cylindrical, borelike aperture 22*a* (shown in phantom) is provided along the axes of the segments 30*a*–30*e* of the magnet carrier 30 into which is inserted the shaft subassembly of FIG. 4 discussed earlier. Each of the segments includes, along the length of the borelike aperture 22a, and open-ended slot 62 as illustrated in FIG. 8. This slot allows the segments 30a–30e during assembly to be slid over and/or positioned upon the locking pins 40 which extend into the slot 62 so as to preclude rotational movement on shaft 22 of those segments engaged by the pins 40. Such a locking feature is illustrated in FIGS. 1 and 2 with regard to carrier segments 30a, 30c and 30e.

In practice, it has been found that very accurate longitudinal alignment of the segments 30a–30e on the shaft 22 can be accomplished by use of the locking pins 40 to retain sections 30a, 30c and 30e in position, while intermediate sections 30b, 30d can have their ends adhered to adjacent sections 30a, 30c, 30e by use of an appropriate adhesive. To ensure overall alignment of the magnet carrier segments 30a–30e after they have been sequentially slid on to the subassembly of FIG. 4, a rigid metal bar having a width substantially equal to the width of one of the channels 60a–60f can be inserted into such a channel to align all of the segments with each other. Subsequently, the alignment bar member is removed and an appropriately sized magnet strip is put in its place as part of the final assembly of the magnet roll.

With particular reference to FIGS. 6 and 7, the magnet strip 50a is illustrated, it being understood that the other magnet strips 50b–50f are generally identical to strip 50a but for different cross sectional dimensions as shown most clearly in FIG. 2. Strip 50a, and its associated strips 50b–50f are generally equal in length to the overall length of the magnet carrier 30 constituted by the segments 30a–30e. The magnet strip 50a has an outer working surface 52 (a north pole as illustrated in FIG. 7) that lies in a surface of revolution about the axis A—A (see FIG. 1) as do the working surfaces of the corresponding magnet strips 50b–50f. The strip 50a also includes an underside or lower surface 54 (a south pole as illustrated in FIG. 7) and opposed sidewalls 56, 57. The underside or lower surface 54 includes a centrally located tongue 58 of rectangular cross section generally matching that of the groove 68 discussed earlier with regard to FIGS. 5 and 8.

With specific reference to FIGS. 6, 7 and 8, the magnet strip 50a is mounted, preferably by use of a pressure sensitive adhesive between surface 54 and portion 64, within the channel 60a with the lower surface 54 of the magnet strip 50a being in a generally contiguous relationship with the bottom portion 64 of the channel 60a, the tongue 58 being fitted into the groove 68 so as to accurately align and center the magnet strip 50a within the channel 60a. In a similar fashion, magnet strips 50b–50f are respectively mounted within their channels 60b–60f. Wherein the respective tongue and groove portion function as a preferred form locator means for the strips 50a–50f, other equivalent locator means could be used without departing from the scope of the invention.

With further reference to FIG. 2, and in accordance with the present invention, the widths of the strips 50a–50f are by design less than the widths of the channels 60a, 60f so that tongue and groove means located between the lower surface of the magnets and the bottom portion of the groove, function as a sole locator means for aligning the magnet strips in position. Thus, spacing is provided between the sidewalls of the magnet strips and the sidewalls of the associated channels. This allows for accurate positioning of the magnet strips along their entire length in desired circumferentially-spaced positions along radial plane lines A, B, C, D, E, F, (see FIG. 8) which are, by design, at precise angles relative to plane F' within which flat 25 (see FIG. 1) lies.

From the foregoing, it can be seen the resultant segmented carrier 30 is an elongated form and is hollow to be telescopically slidably fitted over the shaft 22. The carrier 30, extruded to the cross section as shown in FIG. 8, has an outer periphery provided with the plurality of generally square-shaped, elongated magnet strip retaining channels 60a–60f so formed that the bottom portions thereof are flat and lie in planes normal to radii (A–F) emanating from the axis A—A, these radii essentially bisecting the width dimensions of these bottoms. Ideally, these radii define planes which lie midway between and are parallel to the opposite sides of the respective channels.

Each channel bottom portion is also provided with an elongated groove (e.g. 68) symmetrically bisected by an aforementioned radial plane, the cross-sectional shape of the groove preferably being rectangular as shown.

The interior of the carrier 30 is formed with a plurality of axially extending bridge portions or ribs (e.g. 68a) having inner extremities that terminate precisely at the cylindrical surface of the shaft 22. All rib and wall thicknesses of the carrier 30 are made to be as thin as possible but yet provide suitable rigidity to the carrier 30 so as to serve the intended purpose of the finished roll assembly 10 shown in FIGS. 1 and 2.

Also formed in the carrier 30, as earlier noted, is the axially extending key way or slot 62 adapted to slidably receive the pins 40 as shown in FIGS. 1 and 2. The carrier 30 can thus be slidably telescoped over shaft 22 in such a manner to provide for a snug fit, the walls of the slot 62 also slidable engaging the pins 40 thereby orienting all of the various channels 60a–60f relative to the flat 25 on the stub shaft 24.

To assure adequate rigidity in the bottoms of the various channels 60a–60f, the respective ribs (e.g. 68a) are located either at the midportion thereof or immediately adjacent thereto as illustrated. The ribs thereby impart rigidity by reason of engagement with the shaft 22.

As noted earlier, the carrier 30 is composed of the plurality of shorter, extruded length segments 30a–30e, these segments being identically formed from the same extruding die so as to be as near duplicates as possible. In assembling these segments to the shaft 22, they are telescoped thereover in such position that the respective slots 62 fit over the pins 40.

To assure this alignment, an accurately machined, elongated bar of aluminum is fitted into a particular one of the elongated channels as noted earlier, the width of this aluminum bar conforming identically to the width of the channel receiving it. This serves to circumferentially orient all of the segments 30a–30e such that as a single unit they may all be telescoped over the shaft 22.

Prior to this assembly, however, a suitable adhesive in liquid form is applied either to the butting ends of the segments as noted earlier, to the shaft 22 or both so that as the segments are assembled over the shaft 22, they may be intimately pressed together for a period of time required for the adhesive to cure and solidify. The carrier 30 is thus completed and is in the form of a unitary, solidified, rigid body.

Regarding the earlier discussed magnet strips 50a–50f, they are assembled into the respective strip receiving channels 60a–60f and are secured therein, as noted earlier, by means of some suitable adhesive such as a pressure-sensitive adhesive. These magnet strips are identically formed by extruding and essentially are of the same cross-sectional shape, varying in size as shown in FIGS. 2 and 3. A more detailed description of one of these, however, will suffice for all.

These magnet strips are flexible being formed of a suitable elastomeric plastic, such as chlorinated polyethylene filled with permanent magnet, barium ferrite particles suitably oriented during the extruding process to provide north-south polarities through the thickness thereof. For example, as shown in FIG. 2, the particular strip magnet 50a there shown has a north pole on the outer periphery and a south pole on the bottom side as noted earlier. The various magnet strips about the circumference of the carrier 30 will have polarities as desired.

The outer surfaces of the strips are curved to conform to the cylindrical surface of the roll and the inner surfaces are made flat and are provided with elongated tongues (e.g. 58) to fit into the respective grooves (e.g. 68) described in connection with FIGS. 4–8. The cross-sectional shapes and dimensions of the individual strips 50a–50e are formed to fit with clearance respective ones of the strips-receiving channels 60a–60f, and the tongues (e.g. 58) are sized and shaped to have an intimate press fit with the respective grooves (e.g. 68). Since the strips are formed of flexible elastomeric material, the tongues may be press fitted into the respective grooves thereby providing a secure and positive location of the respective strips within the magnet strip retaining channels.

It is an objective to locate the longitudinal centerlines of the magnet strips precisely in radial planes that include the axis of rotation A—A. Also, the angular position of the magnet strip center with respect to the flat 25 is critical and this is assured by reason of the previously described pin 40 and slot 62 connection. With respect to this angular position, a design objective is to hold the location of each magnet strip to a quarter of a degree of accuracy.

In the prior art, as noted earlier, magnet rolls have been produced utilizing flexible strip magnets essentially like those disclosed herein but not including the locating means constituted by the tongue and groove means disclosed herein. These prior art magnet strips have been located within the respective retaining channels by engagement of the strip edges with the channel sides.

However, in mass production, it has proven to be difficult and expensive to size and shape the grooves and strips such that the strip center line locates precisely in the central radial plane (for example, planes A–F, FIG. 8) that includes the roll axis A—A. For example, if the strip is narrower that its retaining channel, the strip usually engages one groove wall and thereby locates off center. Also, the strip can engage both groove walls at different places along the lengths thereof thereby altering the location of the magnet center line relative to central radial plane at different positions along the length of the strip.

To aggravate this problem further, in such prior art arrangements the magnet strips are conventionally extruded. As extruded, the width dimension of the magnet can vary along its length within normal tolerances which causes a corresponding lateral variation of the magnet center line relative to the radial plane depending upon which channel wall is engaged.

As is now apparent, by utilizing a centering tongue (e.g. 58) and a groove (e.g. 68), a magnet strip can be retained precisely centered relative to the radial plane.

Also, the wider the extrudate, the greater will be the dimensional variation. Conversely, the narrower the extrudate, the smaller the variation will be.

Applying this to the present invention, and considering the strip width as against the tongue width, it will be noted that the former may be greater by a factor of 10. For example, strip width may be ½ inch while the tongue width may be 0.05 inch. Thus, for a given length of extrusion, the actual dimensional variation in the strip width will be larger than that for the tongue width. This smaller tolerance for the tongue (e.g. 58) becomes useful for maintaining the center line of the magnet registered with its radial plane since because of the interference fit of the tongue 58 with its groove 68, the smaller, actual tolerance in the tongue width governs the centerline location of the strip 50a. Variations in strip width along the length thereof are essentially prevented from affecting strip location relative to its radial plane.

This centered condition can only prevail so long as the groove (e.g. 68) remains symmetrically centered relative to this radial plane. This means, therefore, that the carrier 30 must be suitably formed such that the center line of each groove (e.g. 68) coincides with its respective radial plane as shown in FIG. 8.

The carrier 30, as explained previously, is made of a plurality of extruded, plastic segments (FIG. 4), and it is this segmented concept that makes it possible to realize the desired centering accuracy which otherwise does not exist when the carrier 30 is extruded as a single piece for the entire length thereof. This is explained as follows.

If only a single extrusion were used for the carrier 30, normal extrusion defects such as cooling of the extrudate causes local artifacts and distortions in the axial and radial planes. These result in twist and other dimensional problems. As the length of the extrudate increases, this dimensional distortion increases. Thus, if the carrier 30 were extruded in a single length, a dimensional distortion at one end relative to the other could be substantial.

Since this dimensional distortion between ends is difficult if not impossible to avoid in the extrusion process, it becomes necessary to utilize some means for minimizing the problem, and this is accomplished in the present invention by fabricating the carrier 30 of a plurality of short, extruded or injection molded lengths instead of a single long one. In a practical working embodiment of this invention, for a roll ten (10) inches long, by extruding or molding the sleeve segments 30a–30e to lengths of approximately two (2) inches, the dimensional discrepancies between end portions can be held to very small values. By combining several segments end-to-end, dimensional uniformity can be held substantially constant from end-to-end of the finished carrier 30. Since each groove (e.g. 68) is to be symmetrically bisected by its respective radial plane, it becomes obvious that this method of carrier fabrication provides a means for realizing this radial alignment over substantially the entire length of the carrier itself.

From the foregoing it can be seen that the following invention features are provided:

A magnet roll is provided that is economical to manufacture and fulfills the structural requirement of providing axial uniformity of the magnets utilized therein. As to axial uniformity, each magnet is axially straight and accurately centered with respect to a plane that includes the roll axis.

Economy of manufacture is attributable to the roll design and materials used, the design employing short lengths of carrier which are fabricated using conventional methods of molding, such as extruding and injection molding. The magnet strips can also be injection molded or extruded by conventionald means.

The design further employes a positive and reliable positioning or strip locator feature which accurated positions each magnet strip in relation to the carrier. In the preferred embodiment, this is the tongue and groove fit between the strip and the carrier wherein an interference fit positively locates the fitted components relative to each other.

It is important that the carrier be as straight as possible. By sequencing, the degreed carrier straightness needed is achieved even though the carrier is molded.

Thus, the invention pertains to two interdependent features, sequencing (segmented assembly) and accurate positioning of the magnets relative to the segmented carrier.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope or effect to the specific embodiment herein shown and described nor in any other way that is inconsistent with the extent to which the progress in the art has been advanced by the invention.

We claim:

1. A magnet roll for an electrophotographic device comprising:

an elongated, cylindrical magnet carrier mountable for rotation on its longitudinal axis, said magnet carrier including a plurality of channels extending along the length of the magnet carrier, the channels being circumferentially spaced about the cylindrical magnet carrier, the channels being radially spaced from and parallel to the said axis, said channels each having a bottom portion;

a plurality of elongated magnet strips mounted and retained within said channels, each magnet strip having an upper working surface and a lower surface generally contiguous with the said bottom portion of its respective channel; and locator means between said bottom portion of the channel and the lower surface of the magnet strip, said locator means aligning said magnet strip within said channel.

2. A magnet roll according to claim 1, wherein said locator means includes tongue and groove means extending along and between said bottom portion of said channel and said lower surface of said magnet strip.

3. A magnet roll according to claim 2, wherein said tongue and groove means is constituted by a groove extending along the length of said bottom portion and a tongue extending from and along the said lower surface, said tongue fitting into and engaging said groove to maintain said strip in a predetermined, aligned position within said channel.

4. A magnet roll for an electrophotographic device comprising:

a plurality of elongated magnet strips; and an elongated cylindrical magnet carrier mountable for rotation on its longitudinal axis, said magnet carrier including a plurality of channels extending along the length of the magnet carrier, the channels being circumferentially spaced about the cylindrical magnet carrier, the channels being radially spaced from and parallel to the said axis, said plurality of magnet strips being mounted and retained within said channels, said magnet carrier including a plurality of cylindrical segments coaxially arranged and longitudinally aligned in end-to-end relationship along the said axis, each segment providing portions of said channels of said carrier.

5. A magnet roll according to claim 4, wherein said segments are generally identical to each other.

6. A magnet roll according to claim 4, wherein said segments are formed from injection molded plastic material.

7. A magnet roll according to claim 4 including a linear, spindlelike member providing said axis of rotation, said cylindrical segments each including a borelike aperture extending along the cylinder axis of said each segment from one end of the segment to the other, said spindlelike member being received by and extending through the borelike apertures of each of said segments when said segments are arranged in end-to-end relationship on said spindlelike member.

8. A magnet roll for an electrographic device comprising:

an elongated, cylindrical magnet carrier formed from a plurality of substantially identical cylindrical segments mounted in an end-to-end relationship in longitudinal alignment, said magnet carrier formed from said segments providing a plurality of linear channels extending along the length of the magnet carrier, the channels being circumferentially spaced about the cylindrical magnet carrier, the channels being radially spaced from and parallel to each other and to said axis, said channels each having a bottom portion and opposed side walls;

a plurality of elongated, flexible magnet strips mounted and retained within said channels, the widths of said strips being less than the widths of the respective channels in which said strips are mounted and retained, each magnet strip having an upper working surface and a lower surface generally contiguous with the said bottom portion of its respective channel; and locator means between said bottom portion of the channel and the lower surface of the magnet strip, said locator means aligning said flexible strip within said channel in a predetermined centered position, each magnet strip being located between but spaced from the said side walls of its respective channel.

9. A magnet roll according to claim 8, wherein said locator means includes tongue and groove means extendign along and between said bottom portion of said channel and said lower surface of said magnetic strip.

10. A magnet roll according to claim 9, wherein said tongue and groove means is constituted by a groove extending along the length of said bottom portion and a tongue extending from and along the said lower surface, said tongue fitting into and engaging said groove to maintain said strip in a predetermined, aligned position within said channel.

11. A method of assembling a magnet roll for an electrophotographic device comprising the steps of:

providing a linear, spindlelike member;

providing a plurality of generally identical cylindrical segments of plastic material, each cylindrical segment having a plurality of channels extending along its length, the channels being circumferentially spaced about and radially spaced from the longitudinal axis of the said cylindrical segment, each segment having a central, borelike aperture extending therethrough along the said axis;

placing said segments onto said spindlelike member, said spindlelike member coaxially extending through said apertures;

longitudinally aligning said segments in an end-to-end relationship on said spindlelike member wherein said channels of each segments are aligned with the channels of the other segments;

providing a plurality of elongated magnet strips having lengths generally equal to the overall length of said segments in end-to-end relationship; and mounting and locating said magnet strips within said aligned channels.

12. A method according to claim 11, including the step of providing a linear bar member having a width generally identical to the width of at least one of said channels formed by said aligned segments; and inserting said bar member in said one of said channel to precisely align all of said channels prior to said mounting of said magnet strips.

13. A method according to 11, wherein the said insertion of said bar member to establish channel alignment is temporary.

14. A method according to claim 12, including the step of fixing said segments in position relative to each other, and to said spindlelike member prior to mounting said magnet strips within said channels.

15. A method according to claim 14, including the step of adhering the ends of said segments to each other by means of adhesive to fix them in position relative to each other.

16. A method of assembling a magnet roll for and electrophotographic device comprising the steps of:

fabricating an elongated carrier by molding individual segments of plastic material to the same shape, each segment having channels, each channel having a groove along the length of its bottom;

fitting the segments together in end-to-end relationship with the channels and grooves in alignment; and forming by extrusion molding, elongated strips of magnet material, the strips having along their length tongues which snugly fit the respective grooves thereby being positively positioned relative to such grooves.

17. A method according to claim 16, wherein said strips are elastomeric and are narrower than their associated channels, and wherein said tongues are provided by channel bottoms and said grooves are provided by said elongated strip.

* * * * *